US005540155A

United States Patent [19]

Hill

[11] Patent Number: 5,540,155

[45] Date of Patent: Jul. 30, 1996

[54] FUSE AND A METHOD OF MANUFACTURING IT

[76] Inventor: Robert O. Hill, 24 Torwood Rd.,, Forest Town, Johannesburg, Transvaal Province, South Africa

[21] Appl. No.: 431,346

[22] Filed: Apr. 28, 1995

[30] Foreign Application Priority Data

May 2, 1994 [ZA] South Africa ..... 94/2996

[51] Int. Cl.[6] ..... C06C 7/00; C06D 5/06; C06B 21/00

[52] U.S. Cl. ..... 102/290; 102/275.9; 264/3.2

[58] Field of Search ..... 264/3.2; 102/290, 102/275.9

[56] References Cited

U.S. PATENT DOCUMENTS 2,416,639 2/1947 Pearsall ..... 52/2
3,006,748 10/1961 Zebree ..... 52/2
3,621,558 11/1971 Welsh et al. ..... 29/420
4,314,508 2/1982 Love ..... 102/275.7
4,570,540 1/1986 Bell ..... 102/202

*Primary Examiner*—Peter A. Nelson
*Attorney, Agent, or Firm*—Marshall, O'Toole, Gerstein, Murray & Borun

[57] ABSTRACT

An elongate flexible fuse is provided, preferably by an extrusion process, which consists of an oxidizing agent and a fuel present in quantities which will permit a rate of burning of from 10 seconds/meter to 250 seconds/meter. The oxidizing agent is preferably in finely divided form contained in a combustible matrix of fuel or is admixed with finely divided fuel and both contained in a matrix of different material. The ratio of oxidizing agent to fuel is at least 1:1 by weight.

10 Claims, No Drawings

FUSE AND A METHOD OF MANUFACTURING IT

FIELD OF THE INVENTION

This invention relates to a fuse and to a method of manufacturing it.

BACKGROUND OF THE INVENTION

There are two distinct ways of setting off an explosive charge. The first uses a fuse which burns along its length until the combustion region reaches the explosive and causes detonation of the explosive, either directly or via an intermediate detonator. The second method of setting off an explosive uses detonating cord. Such a cord does not burn, but rather is the subject of continuous detonation along its length.

Considerable research has been put into improving the properties of detonating cords and, for example, British Patents Nos. 1582903 and 1582904 to E I Du Pont de Nemours & Co. are concerned with continuously extruding a core of plasticised explosive and with sheathing that core to protect the core and to prevent necking or kinking of the detonating cord.

Research into fuses, on the other hand, has been neglected and the most commonly used fuse still comprises gun powder in a paper wrapping within a woven outer tube. Such a fuse presents operating difficulties since the powdered gunpowder may not continuously fill the fuse thereby forming a break or "holiday" in the fuse which will of course interrupt the burning and prevent the fuse from achieving its function.

OBJECT OF THE INVENTION

It is an object of the present invention to provide an improved fuse and a method of manufacturing same.

SUMMARY OF THE INVENTION

According to a first aspect of the present invention, there is provided an elongate flexible fuse which fuse comprises an oxidising agent and a fuel, the oxidising agent and fuel being present in quantities such that the fuse burns at a rate of from 10 seconds/meter to 250 seconds/meter, when ignited.

Preferably, the oxidising agent and fuel are present in the fuse in quantities such that the fuse burns at a rate of from 90 seconds/meter to 110 seconds/meter.

This aspect of the invention also provides for the fuse to comprise a finely divided oxidising agent uniformly distributed in a flexible elongate matrix of fuel material, for the fuel material to be combustible plastics or elastic plastics material and for the oxidising agent to be any electron acceptor material capable of sustaining or promoting combustion in a fuel material.

Still further features of this aspect of the invention provide for the fuel and oxidising agent to be present in uniform admixture in a common flexible elongate binder or matrix or for the oxidising agent to be a flexible matrix or binder to contain the fuel material.

The invention also provides a fuse as defined above contained in an outer protective sheath.

A second aspect of this invention provides a method of manufacturing a flexible, elongate fuse comprising extruding, to produce said fuse, an extrudable composition containing an oxidising agent and a fuel, the oxidising agent and the fuel being present in quantities such that the fuse burns at a rate of from 10 seconds/meter to 250 seconds/meter, when ignited.

DETAILED DESCRIPTION OF THE INVENTION

In one preferred embodiment of this invention a finely divided oxidising agent is uniformly distributed in a flexible elongate matrix of plastic material capable of being burnt.

Suitable fuels are thermoplastic and thermosetting plastic materials as well as natural or synthetic organic polymers. Examples of such materials are: soluble nitrocellulose, and mixtures of an organic rubber and a thermoplastic terpene hydrocarbon.

Other fuel materials that may be used include polyamides, polyolefins, and vinylic polymers.

Suitable oxidising agents include sulphur and, in general, solid salts such as ammonium potassium, sodium and calcium salts, of chloric, perchloric, nitric and permanganic acids are suitable for use as the oxidising agents of the present invention, although any other suitable oxidising agent or oxidising agent/fuel material combination may be employed.

The fuse of the present invention may have an oxidising agent and fuel combination similar to those known as solid rocket fuels subjected to suitable known plasticization techniques.

The fuse can be made in any suitable manner but is preferably made by an extrusion process.

Conventional extrusion or spinnaret technology may be used in producing the extruded fuse of this invention. Such technology will be familiar to one skilled in the art. The extrusion methods described in the aforementioned British Patents Nos. 1582903 and 1582904 may be readily adapted to make the fuses of the present invention.

The fuse may be extruded to any suitable cross-section. In preferred embodiments the fuse of this invention has a solid circular cross-section. In other embodiments, however, the cross-section may be hollow, with one or more tubular passages therein, or may, for example, be multi-lobed in cross-section or of square or triangular cross-section. Some cross-sectional shapes are better than others at resisting necking or kinking and will be preferred where circumstances so dictate.

It will also be appreciated that two or more extruded strands may be combined to form the fuse, e.g. by twisting together two or more such strands to form a cable or by braiding, weaving or plaiting the strands together to form the fuse.

In an alternative embodiment the fuse may have the oxidising agent and the fuel material each present in uniform admixture in a flexible, elongate binder or matrix. In such a case, it is not important that the fuel material itself be a plastic or elastic material, it may be, for example, a finely divided solid mixed with finely divided oxidising agent in a common binder or matrix.

In a third embodiment of the present invention, the oxidising agent itself may be a flexible matrix or binder containing fuel material. For example, it is envisaged that plastic sulphur may be used as the oxidising agent and that the plastic sulphur may contain finely divided and uniformly distributed zinc dust as the fuel material.

Generally the ratio between the oxidising agent and fuel material present in the fuse is such as to achieve oxygen balance, although a latitude ±20 is acceptable. In practice, the oxidising agent is likely to be present in a ratio of at least 1:1 by weight, in relation to the fuel material.

The fuse of the present invention does not require an outer sheath or cover although such a sheath or cover may be provided therefor if desired. It has been found, for example, that fuses subjected to very rough handling during their disposition in mining operations suffer, if no outer cover or sheath is present, abrasion of the fuse which can modify the burning rate of the fuse. Similarly, wet conditions in a mine may make it desirable to protect the fuse from external moisture.

Where an outer cover or sheath is included, this may be produced by a co-extrusion process simultaneously with or after the fuse-extrusion process or may be produced e.g. by a weaving or yarn-wrapping technique. The sheathing techniques described in the aforementioned British Patents Nos. 1582903 and 1582904 are applicable to the method of the present invention.

Any other suitable method of producing an outer cover or sheath for the fuse may be employed. For example, it is envisaged that a pre-formed plastics tube could be shrunk to fit around a fuse drawn therethrough, by means of a heat-shrinking operation.

It will be understood that the fuse of this invention can be made in many different forms provided the oxidising agent when not providing a matrix to contain the fuel, is finely divided and the mixture of oxidising agent and fuel is such that the specified burning rate is achieved.

What I claim as new and desire to secure by Letters Patent is:

1. An elongate flexible fuse which fuse comprises an extruded flexible matrix of an admixture of an oxidising agent and a fuel, the oxidising agent and fuel being present in quantities such that the fuse burns at a rate of from 10 seconds/meter to 250 seconds/meter, when ignited.

2. An elongate flexible fuse as claimed in claim 1 in which the oxidising agent and fuel are present in the fuse in quantities such that the fuse burns at a rate of from 90 seconds/meter to 110 seconds/meter.

3. An elongate flexible fuse as claimed in claim 1 in which the oxidising agent is finely divided and uniformly distributed in a flexible elongate matrix of fuel material.

4. An elongate flexible fuse as claimed in claim 3 in which the fuel material is a combustible plastics material.

5. An elongate flexible fuse as claimed in claim 1 in which the oxidising agent and fuel are present in uniform admixture in a common flexible elongate matrix.

6. An elongate flexible fuse as claimed in claim 5 in which the admixture is a finely divided solid fuel mixed with a finely divided oxidising agent.

7. An elongate flexible fuse as claimed in claim 1 in which the oxidising agent is a flexible matrix containing the fuel material.

8. An elongate flexible fuse as claimed in claim 1 in which the oxidising agent is present in a ratio of at least 1:1 by weight, in relation to the fuel material.

9. An elongate flexible fuse as claimed in claim 1 which is contained in an outer protective sheath.

10. A method of manufacturing a flexible, elongate fuse comprising extruding, to produce said fuse, an extrudable composition containing an oxidising agent and a fuel, the oxidising agent and the fuel being present in quantities such that the fuse burns at a rate of from 10 seconds/meter to 250 second/meter, when ignited.

* * * * *